US006203424B1

(12) United States Patent
Gallant

(10) Patent No.: US 6,203,424 B1
(45) Date of Patent: Mar. 20, 2001

(54) VENTING APPARATUS

(76) Inventor: Gerard J. Gallant, 54 Lakeview Ave., Waltham, MA (US) 02154

( * ) Notice: Subject to any disclaimer, the term of this patent is extended or adjusted under 35 U.S.C. 154(b) by 0 days.

(21) Appl. No.: 09/080,379

(22) Filed: May 18, 1998

(51) Int. Cl.[7] ..... F24F 7/00
(52) U.S. Cl. ..... 454/365; 52/199
(58) Field of Search ..... 52/199; 454/365

(56) References Cited

U.S. PATENT DOCUMENTS 2,868,104 * 1/1959 Honholt et al. ..... 454/365
5,149,301 * 9/1992 Gates ..... 454/365
5,352,154 * 10/1994 Rotter et al. ..... 454/365
5,458,538 * 10/1995 MacLeod et al. ..... 454/365
5,803,805 * 9/1998 Sells ..... 454/365 X
5,902,432 * 5/1999 Coulton et al. ..... 454/365 X

* cited by examiner

*Primary Examiner*—Harold Joyce
(74) *Attorney, Agent, or Firm*—Damon J. Borrelli

(57) ABSTRACT

A venting apparatus being used in for the ventilation of roof structures. The venting apparatus includes at least two side panels in juxtaposition to each other. A series of support elements hold the side panels at a selected height. Channels between the support elements permit the movement of air from the ambient external environment to the inside of the architectural structure on which the venting apparatus is positioned. A mesh side element extends between the support elements and provides both a baffle to the movement of air and a mechanical barrier to the infiltration of large airborne materials, animals, and birds.

19 Claims, 3 Drawing Sheets

VENTING APPARATUS

BACKGROUND OF THE INVENTION

1. Field of the Invention

The present invention relates to a venting apparatus. More particularly, it relates to a roof venting apparatus.

2. Description of the Prior Art

The ventilation of roof structures is of vital importance in connection with both residential and commercial construction. In particular, constant, efficient, and safe ventilation of roof structures, and the materials used in the construction of roof structures, is necessary for a wide variety of reasons. Indeed, both the long term structural stability and efficiency of roof structures can be dramatically impacted by the presence or absence of effective roof ventilation systems.

Roof ventilation systems function to permit the movement of air across the obverse of a roof structure. Typically, air enters along one edge of the roof structure and exits through a centrally located vent. In residential construction, air normally enters through apertures positioned along the lower edge of the eves. The air then travels along the underside of the roof structure and exits via an aperture, or apertures, at the ridge of the roof. Depending on the architectural configuration and size of the structure, the edge and central apertures can be individual units or extend continuously along the relevant portions of the structure. Movement of the air from the edge to the center of the roof structure can be passive or facilitated by a mechanical means.

Effective ventilation can have several positive results. Of particular importance is the positive impact of gradual cooling and heating of the roof structure in response to changes in ambient environmental conditions. For example, by assisting to gradually increase or decrease the temperature of a roof structure during the winter months water damage resulting from snow and ice is decreased if not avoided. Likewise, during summer periods effective ventilation assists in the cooling of the entire structure. Fortuitously, these effects also reduce the occurrence of mildewing or rotting of the wood or other material functioning as a supporting or underlying material. In turn, this result can assist to significantly extend the effective life span of all the materials used to form roof structures.

Several apparatus are currently available for use as coverings for the central, or ridge, vents utilized in connection with commercial and residential construction. Although effective in some circumstances, they suffer from several operational and structural deficiencies. For example, due to a lack of effective baffling, wind and airborne materials often are able to penetrate through these coverings and, thus, enter the commercial or housing structure. Likewise, animals are frequently able to enter through those coverings which are currently available. The entry of high velocity wind, airborne particulate material, or animals can result in significant internal damage to the structure and materials contained therein.

A need exists for a venting apparatus which is simple in construction and does not suffer from the limitations of prior art devices.

SUMMARY OF THE INVENTION

It is an object of the present invention to provide a venting apparatus that does not suffer from the foregoing disadvantages and limitations.

It is another object of the present invention to provide a venting apparatus that is simple in construction and compact in design.

It is yet another object of the present invention to provide a venting apparatus that is easy to install and maintain.

It is yet another object of the present invention to provide a venting apparatus that is easily and economically produced, and readily assembled.

Other general and specific objects of the invention will in part be obvious and will in part appear hereinafter.

The venting apparatus of the invention is generally characterized by at least two side panel elements, at least two support elements, and a mesh side element. The venting apparatus of the invention is configured for use in connection with both residential and commercial architectural structures. More particularly, the venting apparatus of the invention is configured to be positioned on the roof of virtually any architectural structure and provide ventilation therefor.

At least two side panel elements are employed in the venting apparatus of the invention. Typically, the venting apparatus of the invention incorporates two of the side panel elements in juxtaposition to each other. Each of the side panel elements has a first surface and a second surface. Generally, the side panel elements have a substantially rectilinear lengthwise configuration and a substantially rectilinear cross-sectional configuration. As a result of this configuration, the side panel elements generally have at least two ends and at least two sides. In the currently preferred embodiment of the invention, each of the side panel elements has a series of apertures. Generally, these apertures are located in close proximity to at least one of the ends and at least one of the sides of each of the side panel elements. When assembled for use, the side panel elements are joined together by a flexible joining element. The flexible joining element can be porous if desired.

At least two support elements are attached to the side panel elements described above. One of the support elements is attached to one of either of the first or second surfaces of one of the side panel elements. The other of the support elements is attached to one of either of the first or second surfaces of the other of the side panel elements. Preferably, the support elements are attached to the side panel elements such that they will both be on the same sides of the side panel elements and, thus, extend in the same direction. This configuration is desired so that the support elements can provide mechanical support to lift the side panels above the roof structure upon which the venting apparatus of the invention is positioned for use.

Like the side panel elements, the support elements have a substantially rectilinear lengthwise configuration and a substantially rectilinear cross-section configuration. In addition, each of the support elements have at least three sets of opposing external surfaces. An aperture extends though each of the support elements. More particularly, this aperture extends between one of the sets of opposing external surfaces. Generally, the aperture in the support elements is sized and shaped so that it is substantially congruent with those apertures in the side panel elements. When the apparatus of the invention is assembled for use, the apertures in the support elements and those in the side panel elements are co-axially positioned.

The mesh side element is connected to the support elements such that it extends between the space from one of the support elements to the other of the support elements. Typically, the mesh side element has a porous configuration. Indeed, the mesh side element can be constructed from the same material used to form the flexible joining element note above. As discussed in greater detail below, the mesh side element acts as a both baffle and a mechanical barrier.

The invention accordingly comprises the steps and apparatus embodying features of construction, combinations of elements and arrangements of parts adapted to effect such steps, as exemplified in the following detailed disclosure, the scope of the invention being indicated in the accompanying claims.

BRIEF DESCRIPTION OF THE DRAWINGS

A fuller understanding of the nature and objects of the present invention will become apparent upon consideration of the following detailed description taken in connection with the accompanying drawings in which.

DETAILED DESCRIPTION OF THE PREFERRED EMBODIMENTS

Figure 1:
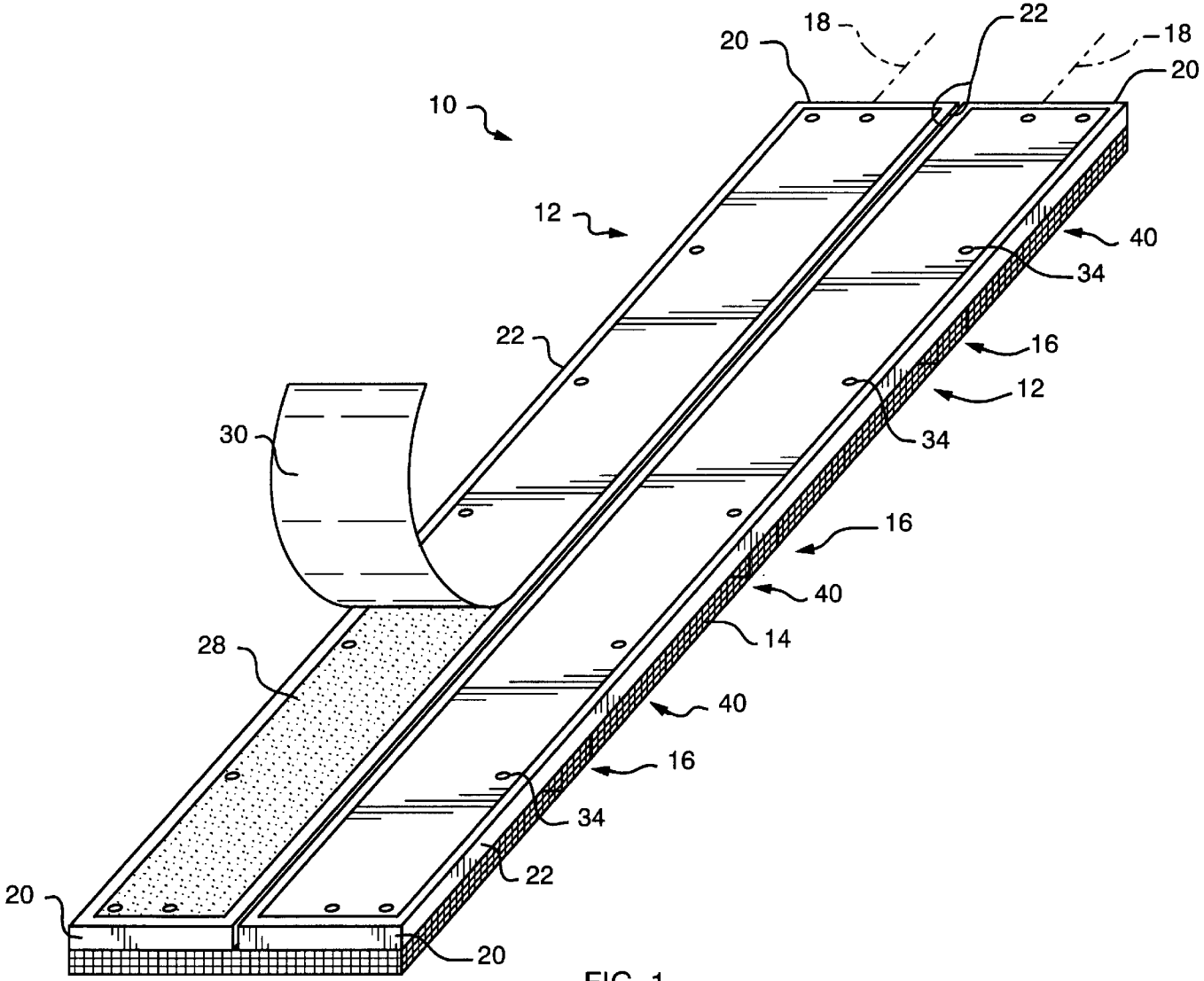
FIG. 1 is a perspective view of a venting apparatus in accordance with the invention.
Figure 2:
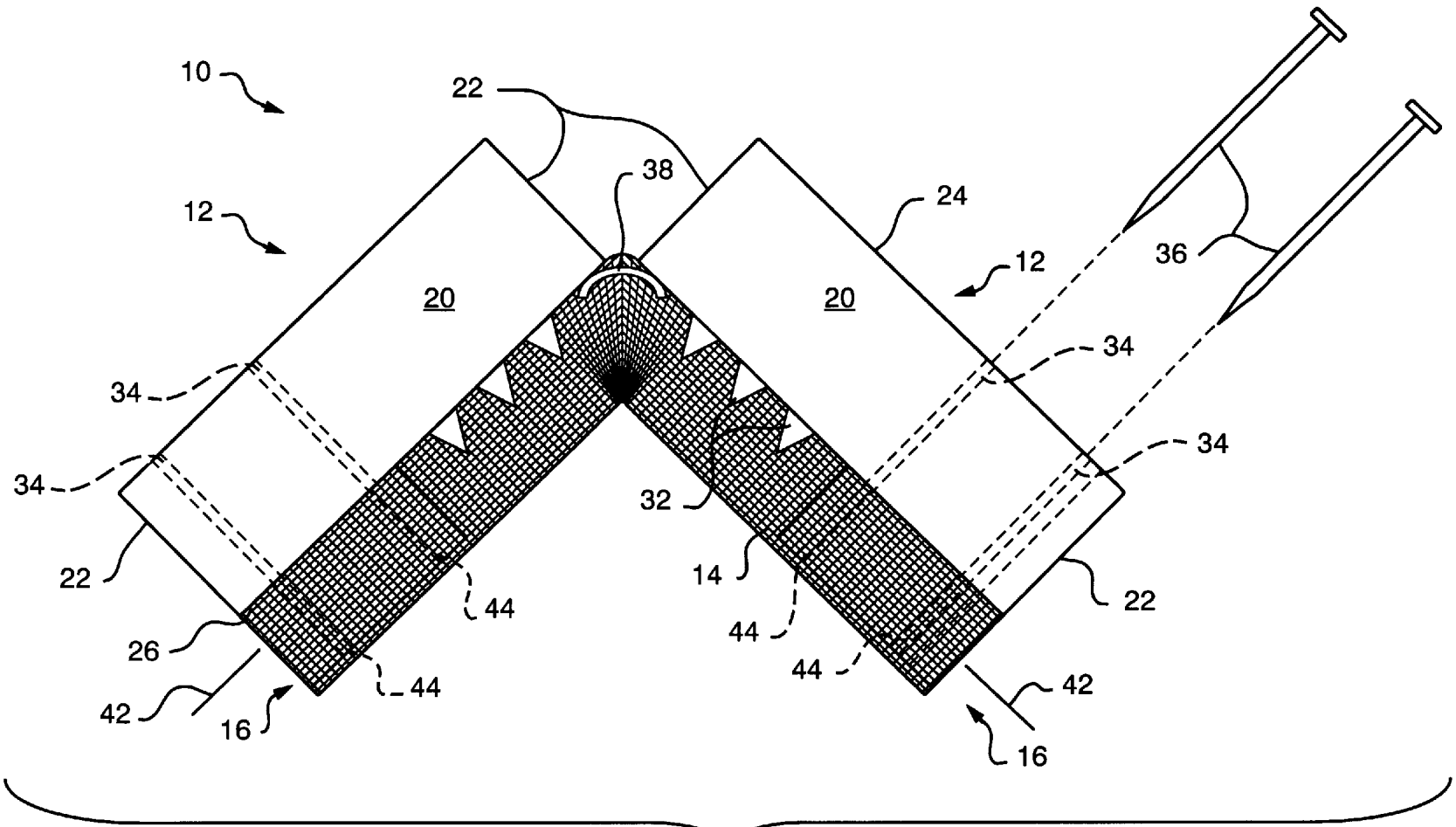
FIG. 2 is a side view of a venting apparatus in accordance with the invention wherein opposing side panels have been deployed for attachment to a pitched roof.
Figure 3:
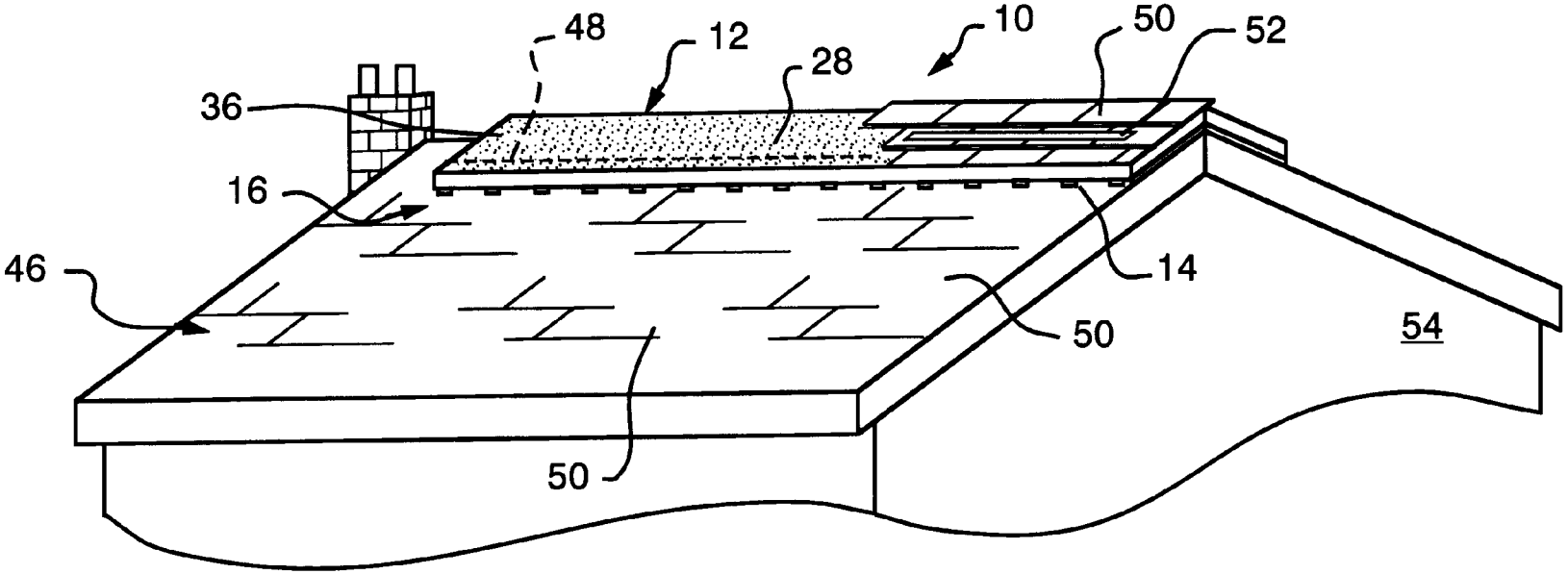
FIG. 3 is a perspective view of a venting apparatus in accordance with the invention positioned on the ridge of a roof structure.

Referring now to FIGS. 1 through 3, there is shown a venting apparatus of the invention 10. The venting apparatus of the invention 10 includes at least two side panels 12, a mesh side element 14, and a series of support elements 16.

As shown best in FIGS. 1 and 2, the side panels 12 typically are planar in form and configured to extend longitudinally along an axis 18. The cross-sectional configuration of the side panels 12 can be selected as needed for a given application. Typically, however, the side panels 12 have a rectilinear cross-sectional configuration. This configuration is desired in order to facilitate placement of the side panels 12 on a roof structure 46 as discussed below in connection with FIG. 3. Although the side panels 12 can be manufactured from virtually any dynamically stable material, including metals, plastics, or cellulosic substrates, in the preferred embodiment of the invention the side panels 12 are manufactured from wood. More particularly, the preferred material for manufacturing of the side panels 12 is plywood.

Each side panel 12 has a pair of ends 20 and a pair of sides 22. A top surface 24 extends between the ends 20 and sides 22. On the obverse of each of the side panels 12, a bottom surface 26 extends between the ends 20 and sides 22.

As noted above, the side panels 12 have a generally planar configuration. Normally, the width of the ends 20 are selected in order to provide sufficient coverage for an aperture 48 in a roof structure 46 as shown in connection with FIG. 3. Accordingly, the width of the ends 20 can either be custom fitted for a specific application or produced to a standardized width. Likewise, the length of the sides 22 is also selected based on the size of the aperture 48 in the roof structure 46. Accordingly, this dimension can be either configured to accommodate a specific sized aperture 48 or custom-built for a given application.

Structurally, the top surface 24 can be textured or smooth depending upon the application in which the venting apparatus of the invention 10 is employed. If desired, in order to blend the venting apparatus of the invention 10 into the overall appearance of the roof structure 46, the top surface 24 can be textured so as to have a topography substantially identical to that of the roof structure 46 upon which the venting apparatus of the invention 10 is to be positioned. Alternatively, the top surface 24 can be substantially smooth. This later configuration is preferred when roof shingles 50, as shown in FIG. 3, are to be placed over the venting apparatus of the invention 10 in order to conceal the position of the venting apparatus of the invention 10. When the top surface 24 has a smooth configuration, an adhesive material 28 can be positioned on and over its surface. The adhesive material 28 facilitates the positioning and securing of roof shingles 50 to the top surface 24. If utilized, a removable protective covering 30 is typically positioned over the adhesive material 28 until such time as the adhesive material 28 is to be exposed and roof shingles 50 are to be positioned thereon.

The bottom surface 26 typically has a smooth configuration. Attached to the bottom surface 26 in close proximity to the ends 20 and sides 22 are the support elements 16 discussed in detail below. The bottom surface 26 can also have a series of prong elements 32 extending perpendicularly therefrom. When utilized, the prong elements 32 can be either randomly positioned or positioned in a fixed pattern. In operation, the prong elements 32 function as baffles and, thus, reduce the potential for infiltration of airborne particles from the external environment to the internal portion of the structure upon which the venting apparatus of the invention 10 is positioned. The prong elements 32 can also function to prevent the infiltration of animals and birds.

Extending between the top surface 24 and bottom surface 26 are a series of apertures 34. In the preferred embodiment of the invention, the apertures 34 are evenly spaced and in close proximity to the ends 20 and sides 22. As shown and discussed in connection with FIG. 3, the apertures 34 are configured so as to assist in the attachment of the venting apparatus of the invention 10 to a roof structure 46. More particularly, the apertures 34 are configured to receive an appropriate attachment element 36 without resulting collateral damage to the structural integrity of the venting apparatus of the invention 10 or, in particular, side panels 12. In the preferred embodiment of the invention, the apertures 34 are sized and shaped so as to receive nail, bolt, or screw as appropriate.

In the preferred embodiment of the invention as shown in the several FIGURES, the venting apparatus of the invention 10 is formed using a pair of juxtaposed side panels 12. Of course, a series of side panels 12 can be employed in the event that a larger aperture 48 in a roof structure 46 needs to be covered. Structurally, the side panels 12 are secured together by a flexible joining element 38. The flexible joining element 38 permits the side panels 12 to be moved between a position wherein they are substantially co-planar to one in which their bottom surfaces 26, described above, are facing each other. The flexure provided by the flexible joining element 38 thus permits positioning of the venting apparatus of the invention 10 on a wide variety of styles of roof structures 46. The flexure provided by the flexible joining element 38 also allows the venting apparatus of the invention 10 to be easily and efficiently adapted to a variety of different roof pitches. The flexible joining element 38 typically is manufactured from a mesh material so that it can assist in the exchange of air between the ambient external environment and that environment inside of the architectural structure 54 on which the venting apparatus of the invention 10 is positioned. Although virtually any ductile mesh material can be employed, including metal or plastic, in the preferred embodiment of the invention the flexible joining element 38 is manufactured from a polymer substrate such as nylon or fiberglass. These materials resist degradation by environmental factors such as rain and snow and are of light weight but high strength.

Positioned along the bottom surface 26 of the side panels 12 are a series of support elements 16. The support elements 16 can be attached to the side panels using virtually any method familiar to those skilled-in-the-art. Typical attachment systems include adhesives, bolts, and nails. In the presently preferred embodiment of the invention, the support elements 16 are nailed to the bottom surface 26 of the side panels 12.

The size and number of support elements 16 used for a given application will depend on the overall size of the side panel 12. The dimensions of the aperture 48 in the architectural structure 54 being spanned by the venting apparatus of the invention 10 will also impact on the number, size, and positioning of the support elements 16. Typically, however, the support elements 16 are positioned in close proximity to the ends 20 and sides 22. Channels 40 separate the support elements 16. Functionally, the support elements 16 are sized and shaped to provide support for the side panels 12. The channels 40, which are defined on either side by the support elements 16, permit the exchange of air between the external environment and the inside of the architectural structure 54 on which the venting apparatus of the invention 10 is positioned. Like the side panels 12, the support elements 16 can be manufactured from virtually any substrate. However, in the preferred embodiment of the invention, the support elements 16 are manufactured from plywood.

Structurally, the support elements 16 extend longitudinally along an axis 42 so as to have a rectangular lengthwise configuration. The support elements 16 also typically have a rectilinear cross-sectional configuration. An aperture 44 extends through each the support elements 16 perpendicularly to the axis 42. The aperture 44 has a size and shape that is substantially identical to that of the apertures 34 in the side panels 12. When the venting apparatus of the invention 10 is fully assembled, the apertures 34 in the side panels 12 and the apertures 44 in the support elements 16 are co-axial. In operation, the apertures 44 receive the attachment element 36 after it passes through the apertures 34 in the side panels 12. As the attachment element 36 is tightened, the structural support afforded by the support elements 16 serves to decrease, if not avoid substantially all, deformation of the side panels 12 by providing a mechanical support for the side panels 12.

Extending between the support elements 16 is a continuous mesh side element 14. More particularly, the mesh side element 14 extends over the support elements 16 and across the channels 40. In the embodiment of the invention shown in the several FIGURES, the mesh element 14 has a width equal to, if not slightly larger than, the height of the support elements 16. A width slightly greater than that of the support elements 16 is generally preferred as such a configuration permits the mesh side element 14 to be secured to the roof structure 46, if desired. Although a continuous ribbon of material is preferred for the mesh side element 14, those skilled-in-the-art will appreciate that the mesh side element 14 can also be formed from individual sections extending between the support elements 16 and over the channels 40. Almost any ductile material can be used to manufacture the mesh side element 14 including, for example, metal and polymer substrates. Indeed, virtually any material can be used providing it has the requisite mechanical strength to resist attack by animals yet has a sufficiently open mesh to permit the passage of air between internal and external locations. In the preferred embodiment of the invention as shown in the several FIGURES the mesh element 14 is manufactured from nylon. Typically, the mesh element 14 and flexible joining element 38 are manufactured from the same material.

Operationally, the mesh side element 14 serves to baffle the movement of air from the external environment to the inside of the architectural structure 54 upon which the venting apparatus of the invention 10 is positioned. In addition, the mesh side element 14 provides a mechanical barrier against the infiltration of animals and large airborne particulate matter. Given these functions, the cross-sectional dimensions of the pores of the mesh element 14 will be selected based on the environmental conditions where the venting apparatus of the invention 10 is to be utilized. In this way, the venting apparatus of the invention 10 can be adjusted to suit the needs of virtually any climatic area.

As shown best in FIG. 3, the venting apparatus of the invention 10 can, in residential applications, be positioned along the ridge of the roof structure 46. In order to utilize the venting apparatus of the invention 10, an aperture 48 is first cut into the ridge of the roof structure 46 of the architectural structure 54. Any roof shingles 50 damaged by the lancing of the aperture 48 into the roof structure 46 are replaced so that the line of roof shingles 50 ends at the edge of the aperture 48.

In the next phase, the angle between the side panels 12 is adjusted so that it is substantially identical to the pitch of the roof structure 46. The venting apparatus of the invention 10 is then positioned on the roof structure 46 such that it occults the aperture 48. Attachment elements 36 are then positioned in the apertures 34 and 44 and forcibly positioned into the roof structure 46. In this manner the venting apparatus of the invention 10 is secured to the roof structure 46.

Depending on the style of roof, and the materials used as a roof covering, the venting apparatus of the invention 10 can be covered with roof shingles 50 as desired. If roof shingles 50 are to be positioned on and along the side panels 12, then the covering 30 over the adhesive 28 is first removed. The roof shingles 50 are then positioned on the side panels 12 and nailed thereto. In this manner the roof shingles 50 are securably attached to the side panels 12 by both chemical and mechanical means. If necessary due to climatic conditions, a strip 52 of metal, wood, or other material may be fastened to the side panels 12 over the roof shingles 50. Such fastening of the strip 52 can be achieved using nails or bolts as appropriate. When utilized, the strip 52 serves to assist in connecting the roof shingles 50 to the side panels 12 and, thus, decrease the potential for their removal due to extreme weather conditions.

Once the venting apparatus of the invention 10 is secured in position, air is permitted to move as desired between the external environment and the inside of the architectural structure 54. If desired fans, or other mechanical systems, can be positioned in the aperture 48 to facilitate the movement of air between the external and internal environments.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

What is claimed is:

1. A venting apparatus, said apparatus comprising:

a.) a first side panel means and a second side panel means, said first side panel means and said second side panel means being juxtaposed relative to each other, said first side panel means having a first surface and a second surface, said second side panel means having a first surface and a second surface, a flexible joining means joining said first side panel means to said second side panel means, said first side panel means having a substantially rectilinear lengthwise configuration and a substantially rectilinear cross-section configuration, said first side panel means having at least two end means and at least two side means, said first side panel means having a series of apertures located in close proximity to at least one of said end means and at least one of said side means, said second side panel means having a substantially rectilinear lengthwise configuration and a substantially rectilinear cross-section configuration, said second side panel means having at least two end means and at least two side means, said second side panel means having a series of apertures located in close proximity to at least one of said end means and at least one of said side means;

b.) at least two support means, at least one of said support means attached to one of either of said first surface or said second surface of said first side panel means, said support means positioned on said first side panel means having at least one aperture, said aperture in said support means positioned on said first side panel means being coaxial with at least one of said apertures in said first side panel means, said aperture in said support means positioned on said first side panel means having a size and shape substantially identical to at least one of said apertures in said first panel means, the other of said support means attached to one of either said first surface or said second surface of said second side panel means, said support means positioned on said second side panel means having at least one aperture, said aperture in said support means positioned on said second side panel means being coaxial with at least one of said apertures in said second side panel means, said aperture in said support means positioned on said second side panel means having a size and shape substantially identical to at least one of said apertures in said second panel means; and, c.) a mesh side means connected to said support means such that said mesh side means extends between said support means.

2. The venting apparatus of claim 1 wherein said first side panel means comprises a substantially rectilinear lengthwise configuration and a substantially rectilinear cross-section configuration.

3. The venting apparatus of claim 2 wherein said first side panel means comprises at least two end means and at least two side means.

4. The venting apparatus of claim 3 wherein said first side panel means comprises a series of apertures located in close proximity to at least one of said end means and at least one of said side means.

5. The venting apparatus of claim 1 wherein said second side panel means comprises a substantially rectilinear lengthwise configuration and a substantially rectilinear cross-section configuration.

6. The venting apparatus of claim 5 wherein said second side panel means comprises at least two end means and at least two side means.

7. The venting apparatus of claim 5 wherein said second side panel means comprises a series of apertures located in close proximity to at least one of said end means and at least one of said side means.

8. The venting apparatus of claim 1 wherein said flexible joining means comprises a porous configuration.

9. The venting apparatus of claim 1 wherein each of said support means comprises a substantially rectilinear lengthwise configuration and a substantially rectilinear cross-section configuration, said support means having at least three sets of opposing external surfaces.

10. The venting apparatus of claim 9 wherein said support means comprises an aperture, said aperture extending through said support means and between one of said sets of opposing external surfaces.

11. The venting apparatus of claim 1 wherein said mesh side means comprises a porous configuration.

12. A venting apparatus for use in connection with architectural structures, said venting apparatus being configured to be positioned on the roof of said architectural structures, said venting apparatus comprising:

a.) a first side panel means and a second side panel means, said first side panel means and said second side panel means being juxtaposed relative to each other, said first side panel means having a rectilinear lengthwise configuration, said first side panel means having a first surface and a second surface, said second side panel means having a rectilinear lengthwise configuration, said second side panel means having a first surface and a second surface, a porous flexible joining means joining said first side panel means to said second side panel means, said first side panel means having a substantially rectilinear lengthwise configuration and a substantially rectilinear cross-section configuration, said first side panel means having at least two end means and at least two side means, said first side panel means having a series of apertures located in close proximity to at least one of said end means and at least one of said side means, said second side panel means having a substantially rectilinear lengthwise configuration and a substantially rectilinear cross-section configuration, said second side panel means having at least two end means and at least two side means, said second side panel means having a series of apertures located in close proximity to at least one of said end means and at least one of said side means;

b.) at least two support means, each of said support means having a substantially rectilinear lengthwise configuration and a substantially rectilinear cross-section configuration, said support means having at least three sets of opposing external surfaces, at least one of said support means attached to one of either of said first surface or said second surface of said first side panel means, said support means positioned on said first side panel means having at least one aperture, said aperture in said support means positioned on said first side panel means being coaxial with at least one of said apertures in said first side panel means, said aperture in said support means positioned on said first side panel means having a size and shape substantially identical to at least one of said apertures in said first panel means, the other of said support means attached to one of either said first surface or said second surface of said second side panel means, said support means positioned on said second side panel means having at least one aperture, said aperture in said support means positioned on said second side panel means being coaxial with at least one of said apertures in said second side panel means, said aperture in said support means positioned on said second side panel means having a size and shape substantially identical to at least one of said apertures in said second panel means; and, c.) a porous mesh side means connected to said support means such that said mesh side means extends between said support means.

13. The venting apparatus of claim 12 wherein said first side panel means comprises at least two end means and at least two side means.

14. The venting apparatus of claim 13 wherein said first side panel means comprises a series of apertures located in close proximity to at least one of said end means and at least one of said side means.

15. The venting apparatus of claim 13 wherein said first side panel means comprises prong means extending from one of either of said first surface or said second surface of said first side panel means.

16. The venting apparatus of claim 12 wherein said second side panel means comprises at least two end means and at least two side means.

17. The venting apparatus of claim 16 wherein said second side panel means has a series of apertures located in close proximity to at least one of said end means and at least one of said side means.

18. The venting apparatus of claim 17 wherein said second side panel means has prong means extending from one of either of said first surface or said second surface of said second side panel means.

19. The venting apparatus of claim 12 wherein said support means has an aperture, said aperture extending through said support means and between one of said sets of opposing external surfaces.

* * * * *